US007584560B2

(12) United States Patent
Lee

(10) Patent No.: US 7,584,560 B2
(45) Date of Patent: Sep. 8, 2009

(54) ROTARY SIGN BOARD

(76) Inventor: Gye-Soo Lee, #105-501, Gwangmyung Apt., 336-1, Simgok-dong, Seo-Gu, Incheon (KR)

( * ) Notice: Subject to any disclaimer, the term of this patent is extended or adjusted under 35 U.S.C. 154(b) by 15 days.

(21) Appl. No.: 11/783,734

(22) Filed: Apr. 11, 2007

(65) Prior Publication Data

US 2008/0250686 A1 Oct. 16, 2008

(51) Int. Cl.
*G09F 11/02* (2006.01)
*G09F 11/23* (2006.01)

(52) U.S. Cl. ..... 40/493; 40/473; 40/494

(58) Field of Classification Search ..... 40/473, 40/493, 494, 506
See application file for complete search history.

(56) References Cited

U.S. PATENT DOCUMENTS 4,164,084 A * 8/1979 Crockett ..... 40/660
4,329,801 A * 5/1982 Clausen ..... 40/607.03
5,054,219 A * 10/1991 Hoyt et al. ..... 40/473
6,250,003 B1 * 6/2001 Phinney ..... 40/607.12
6,269,570 B1 * 8/2001 Miles ..... 40/607.03
6,477,800 B1 * 11/2002 Payne ..... 40/582

FOREIGN PATENT DOCUMENTS

JP 2005134530 A * 5/2005

* cited by examiner

*Primary Examiner*—Cassandra Davis
(74) *Attorney, Agent, or Firm*—Robert E. Bushnell, Esq.

(57) ABSTRACT

Disclosed is a rotary sign board having a case split into two or more case sections, wherein the case sections surround the outer periphery of a display assembly, and are adapted to be pivoted through hinge assemblies, thereby being opened or closed, so that an advertisement object can be conveniently replaced. The rotary sign board includes: a frame having a top frame body surrounding a post, and a bottom frame body arranged to be spaced from the top frame body; a display assembly rotatably installed between the top frame body and the bottom frame body of the frame; a case split into two or more case sections, the case sections being arranged between the top frame body and the bottom frame body so as to surround the outer periphery of the display assembly; and hinge assemblies provided at the top and bottom ends of the adjacent lateral edges of the case sections, respectively, so as to allow the case sections to be pivoted.

18 Claims, 14 Drawing Sheets

ROTARY SIGN BOARD

BACKGROUND OF THE INVENTION

1. Field of the Invention

The present invention relates to a rotary sign board, and more particularly, to a rotary sign board having a case for surrounding the periphery of a display assembly, wherein the case is split into two or more case sections adapted to be pivoted through hinge assemblies, so that an advertisement object can be conveniently replaced.

2. Background of the Related Art

Generally, sign boards are frequently installed at places where many people come and go, such as a subway station, a bus terminal, an airport, or a railroad station.

Sign boards installed at a visible place so that many people see the sign boards are typically provided with a flat plate, on which an advertisement object is attached. However, cylindrical sign boards have been developed in order to allow more people to see advertisement information.

FIG. 1 is a cross-sectional view illustrating a cylindrical sign board according to the prior art. As shown in the drawing, the cylindrical sign board includes a rotary barrel 51 surrounding a cylindrical post W with a space formed between the rotary barrel 51 and the cylindrical post W, an advertisement object 50 being installed in the rotary barrel 51, a support barrel 53 for rotatably supporting the rotary barrel 51 where the support barrel 53 being provided with a transparent window 52, a plurality of fluorescent lamps 54 installed within the rotary barrel 51 so as to illuminate the advertisement object 50, and a driving means including a motor M for driving the rotary barrel 51.

The operation of the above-mentioned rotary sign board will be described. If power is applied to the motor M after the fluorescent lamps 54 are turned on, the rotary barrel 51 with the advertisement object 50 is rotated at a predetermined speed by the motor M. If the rotary barrel 51 is rotated at the predetermined speed, the advertisement object 50 is also rotated, so that people can see the advertisement information on the advertisement object 50 through the transparent window 52 in the support barrel 53.

Here, the advertisement object 50 is fabricated by printing advertisement information on a film. If the fluorescent lamps 54 are turned on from the rear side of the advertisement object 50, light transmits the film, thereby permitting the printed advertisement information to be more clearly seen even in the dark.

However, the above-mentioned rotary barrel has a problem in that the transparent window is completely removed from the support barrel in order to replace an advertisement object with a new one. Therefore, the replacement work is complicated and time-consuming.

In addition, the above-mentioned rotary barrel also has a problem in that the advertisement object is formed from one film and fixed to the rotary barrel, which makes the work for installing or removing the advertisement object complicated and time-consuming.

SUMMARY OF THE INVENTION

Accordingly, the present invention has been made in view of the above-mentioned problems occurring in the prior art, and it is an object of the present invention to provide a rotary sign board with a case surrounding the outer periphery of a display unit, wherein the case is split into two or more case sections adapted to be capable of being pivoted through hinge assemblies, so that an advertisement object positioned within the rotary sign board can be conveniently replaced.

It is another object of the present invention to provide a rotary sign board adapted to allow the edges of an advertisement film to be inserted into film insertion slits formed in vertical anchoring bars and horizontal anchoring bars provided in the rotary sign board, wherein the edges of the advertisement film inserted into the film insertion slits are pressed and anchored by anchoring screws inserted through the vertical anchoring bars, so that the advertisement film can be simply and conveniently installed or removed.

It is another object of the present invention to provide a rotary sign board having a plurality of vertical anchoring bars spaced from each other at predetermined intervals, so that a plurality of advertisement films can be fitted in the spaces formed between the vertical anchoring films, respectively, whereby any of the advertisement films can be replaced.

It is another object of the present invention to provide a rotary sign board, in which two adjacent case sections are formed with hinge insertion grooves at the top and bottom ends of one pair of adjacent lateral edges thereof, thereby preventing a gap from being produced in the interface between the two adjacent case sections when the case sections are opened or closed.

It is another object of the present invention to provide a rotary sign board having a locking device for limiting the opening of case sections of the rotary sign board, wherein the locking device is adapted to be prevented from being inadvertently released, so that the loss of the locking device can be prevented.

It is yet another object of the present invention to provide a rotary sign board having a frame anchored to the outer peripheral surface of a post, wherein the frame is adapted to be supported on the post through support arms, each of which is covered by one or more rubber members at the ends thereof, so that the support arms can be elastically anchored to the post.

To accomplish the above objects, according to the present invention, there is provided a rotary sign board comprising: a frame having a top frame body surrounding a post, and a bottom frame body arranged to be spaced from the top frame body; a display assembly rotatably installed between the top frame body and the bottom frame body of the frame; a case split into two or more case sections, the case sections being arranged between the top frame body and the bottom frame body so as to surround the outer periphery of the display assembly; and hinge assemblies provided at the top and bottom ends of the adjacent lateral edges of the case sections, respectively, so as to allow the case sections to be pivoted.

Here, each of the hinge assemblies may comprise an anchoring bracket anchored to the top frame body or the bottom frame body, first and second hinge plates anchored to the split case sections, respectively, and a connection pin inserted through the anchoring bracket, and the first and second hinge plates. As a result, the case sections can be safely pivoted.

Preferably, each of the case sections has a rectangular frame and a transparent window fitted in the rectangular frame.

Preferably, the case sections are provided with a locking device for limiting the opening of the case sections.

The case sections may have an insertion groove and an anchoring groove formed at the top ends of the adjacent edges of the rectangular frames, respectively. In such an event, the locking device may have an elongated leg inserted into the insertion groove, and an anchoring leg inserted into the anchoring groove, the elongated leg and the anchoring leg being formed by being bent downward, wherein the anchoring leg is shorter than the elongated leg so that the locking/release operation is performed by the anchoring leg.

The locking device may further comprise anti-release means for preventing the release of the elongated leg inserted into the insertion groove.

The case section with the insertion groove is formed with a through-hole at one side of the insertion groove, and the elongated leg is formed with an elongated groove on a side thereof. In addition, the anti-release means is implemented by a stop screw inserted through the through-hole so that the tip end of the stop screw is inserted into the elongated groove on the elongated leg inserted into the insertion groove, thereby preventing the loss of the locking device.

If the locking device is provided with a handle at the top thereof, it is easy to release the locking of the locking device.

The top and bottom frame bodies are fixedly installed on the post through a plurality of support arms, the front end of each of the support arms being formed with a bifurcated contact piece so as to be in contact with the post through the contact piece, and the rear end of each of the support arms being anchored to the top frame body or the bottom frame body.

If the ends of contact pieces are covered by rubber members, the frame can be elastically supported and the contact pieces can be prevented from being slit.

The case sections are formed with hinge insertion grooves at the top and bottom ends of one pair of adjacent lateral edges the rectangular frames so as to prevent from a gap being formed in the interface between the case sections.

According to another aspect of the present invention, there is provided a rotary sign board comprising: a frame having a top frame body surrounding a post, and a bottom frame body arranged to be spaced from the top frame body; a display assembly having a top rail rotatably installed on the top frame body, a bottom rail rotatably installed on the bottom frame body, two or more vertical anchoring bars vertically interconnecting the top rail and the bottom rail, each of the vertical anchoring bars being formed with film insertion slits along the opposite lateral edges, a pair of horizontal anchoring bars anchored to the top rail and the bottom rail, respectively, and advertisement films, the edges of which are inserted into the film insertion slits of the vertical anchoring bars and the horizontal anchoring bars; a case split into two or more case sections, the case sections being arranged between the top frame body and the bottom frame body so as to surround the outer periphery of the display assembly; and hinge assemblies provided at the top and bottom ends of the adjacent lateral edges of the case sections, respectively, so as to allow the case sections to be pivoted. As a result, the advertisement films can be easily replaced.

The display assembly may further comprise one or more anchoring screws for anchoring the advertisement films by being inserted through the vertical anchoring bars, so that the advertisement films can be conveniently anchored.

The display assembly may further comprise a support plate arranged between the top rail and the bottom rail in a cylindrical form so as to support the rear sides of the advertisement films.

According to another aspect of the present invention, there is provided a rotary sign board comprising: a frame having a top frame body surrounding a post, and a bottom frame body arranged to be spaced from the top frame body; a display assembly having a top rail rotatably installed on the top frame body, a bottom rail rotatably installed on the bottom frame body, two or more vertical anchoring bars vertically interconnecting the top rail and the bottom rail, each of the vertical anchoring bars being formed with film insertion slits along the opposite lateral edges, a pair of horizontal anchoring bars anchored to the top rail and the bottom rail, respectively, and advertisement films, the edges of which are inserted into the film insertion slits of the vertical anchoring bars and the horizontal anchoring bars; a case split into two or more case sections, the case sections being arranged between the top frame body and the bottom frame body so as to surround the outer periphery of the display assembly; and hinge assemblies, each comprising an anchoring bracket anchored to the top frame body or the bottom frame body, first and second hinge plates anchored to the case sections, respectively, and a connection pin inserted through the anchoring bracket, and the first and second hinge plates.

Here, the display assembly may further comprise one or more anchoring screws for anchoring the advertisement films by being inserted through the vertical anchoring bars.

In addition, the case sections may have an insertion groove and an anchoring groove formed at the top ends of the adjacent edges of the rectangular frames, respectively. In such an event, the locking device may have an elongated leg inserted into the insertion groove, and an anchoring leg inserted into the anchoring groove, wherein the elongated leg and the anchoring leg are formed by being bent downward, and the anchoring leg is shorter than the elongated leg, so that the locking/release operation is performed by the anchoring leg.

The case section with the insertion groove is preferably formed with a through-hole at one side of the insertion groove, the elongated leg is formed with an elongated groove on a side thereof, and the locking device preferably further comprises a stop screw inserted through the through-hole so that the tip end of the stop screw is inserted into the elongated groove on the elongated leg inserted into the insertion groove.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Reference will now be made in detail to the preferred embodiments of the present invention, examples of which are illustrated in the accompanying drawings.

Figure 1:
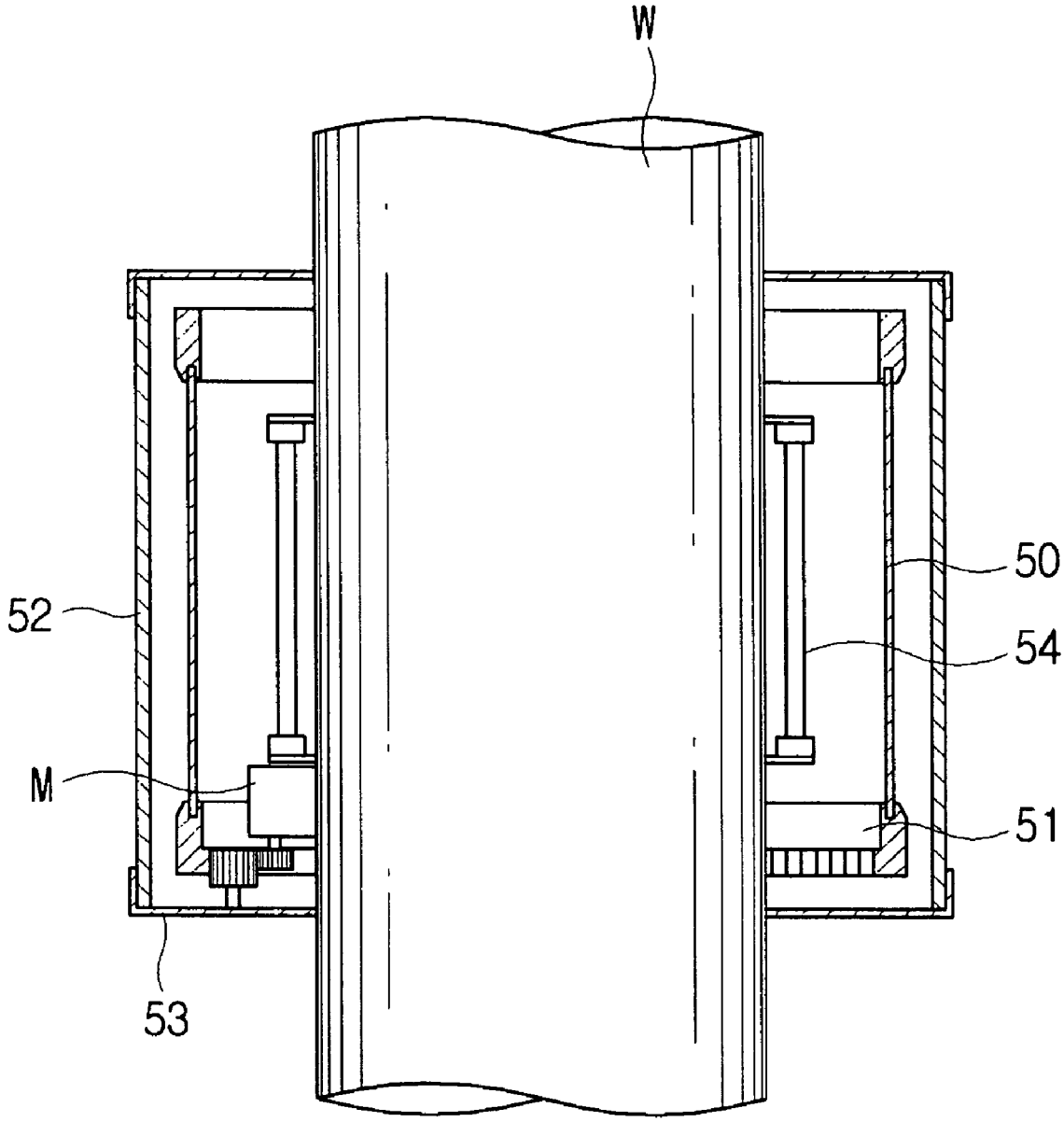
FIG.1 (PRIOR ART)
FIG. 1 is a cross-sectional view illustrating a cylindrical sign board of the prior art.
Figure 2:
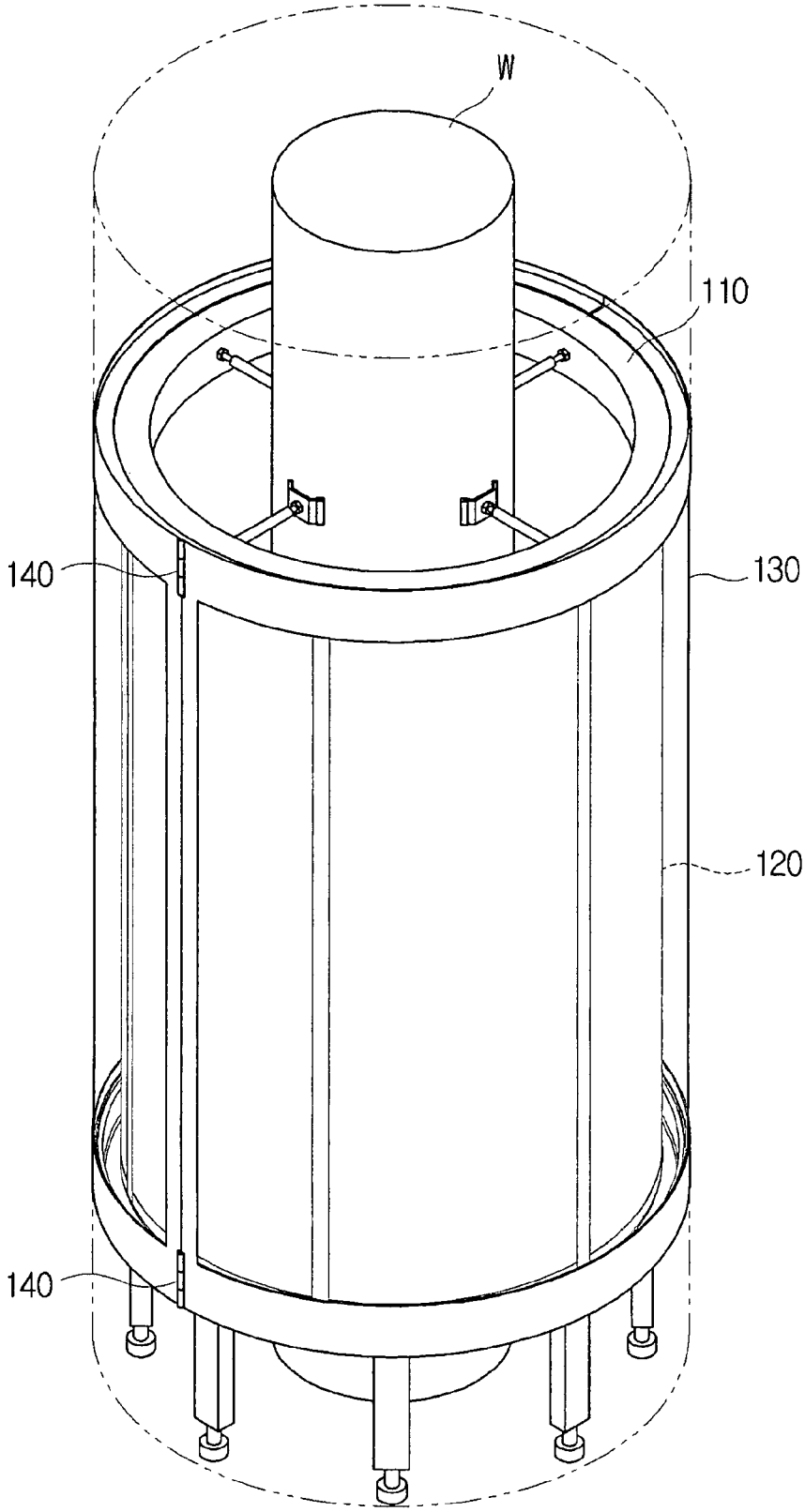
FIG. 2 is a perspective view showing a rotary sign board of the present invention.
Figure 3:
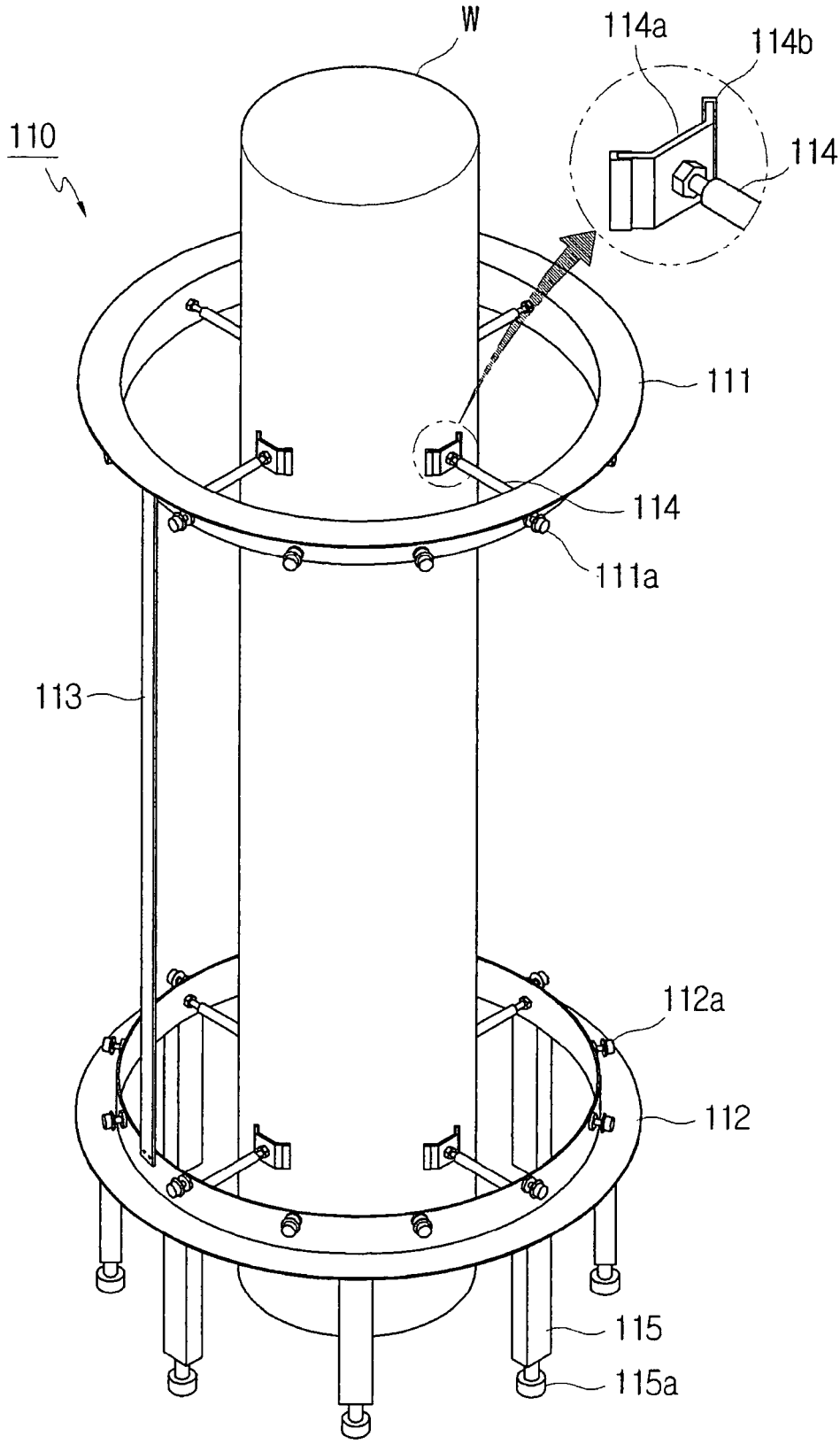
FIG. 3 is a perspective view showing a frame of the rotary sign board of the present invention.
Figure 4:
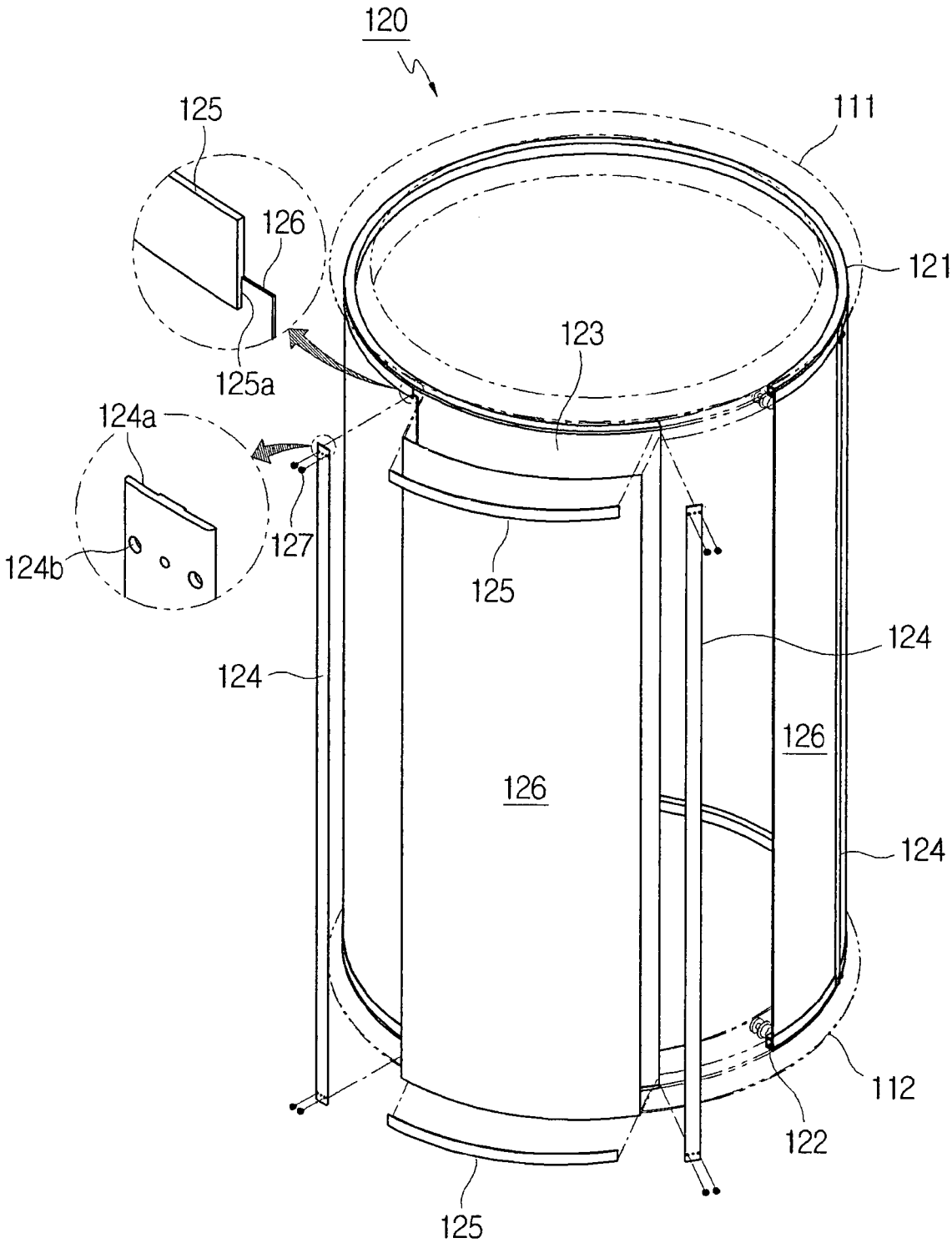
FIG. 4 is an exploded perspective view showing a display assembly of the rotary sign board of the present invention.
Figure 5:
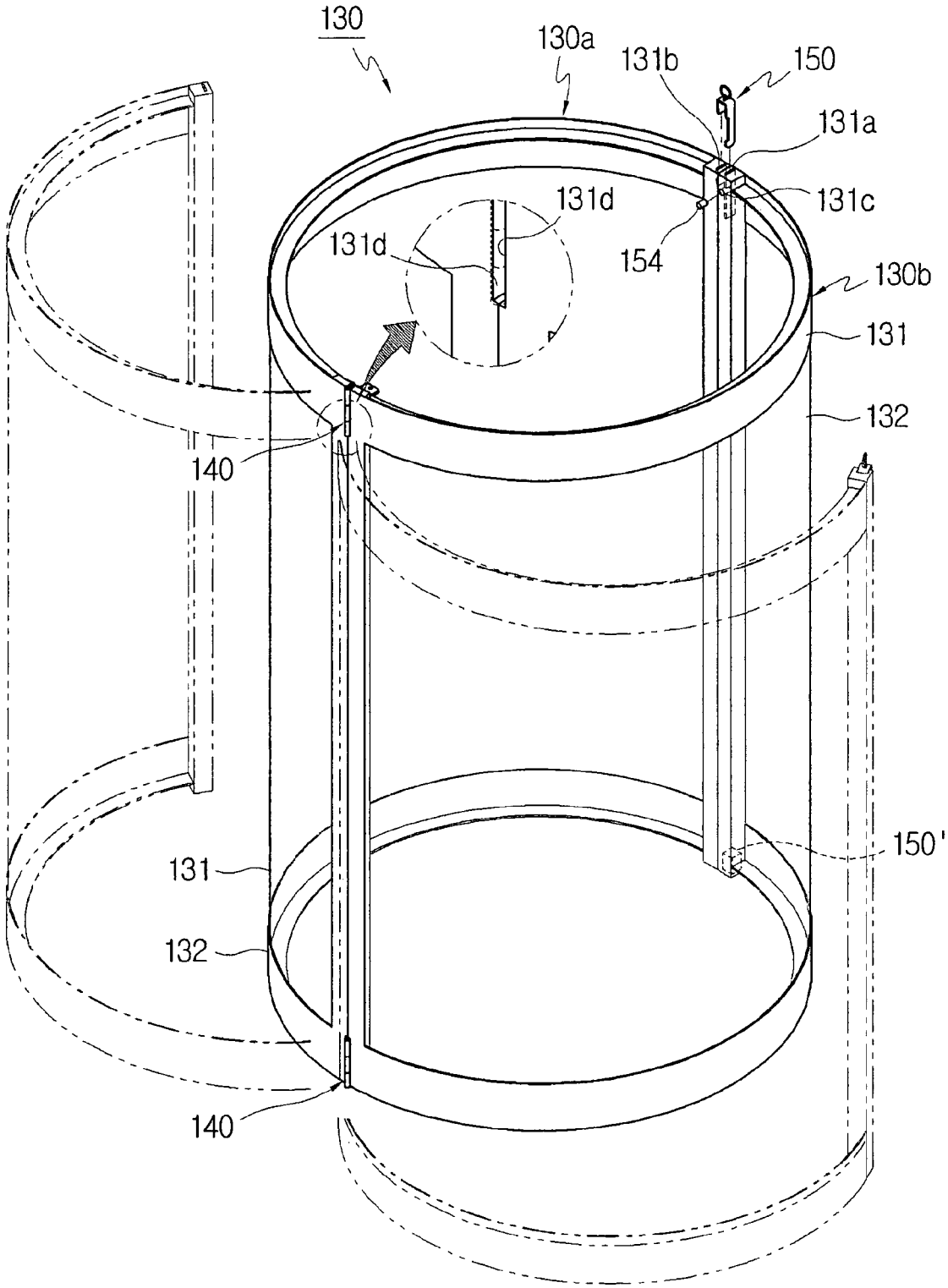
FIG. 5 is a perspective view showing a case of the rotary sign board of the present invention.
Figure 6:
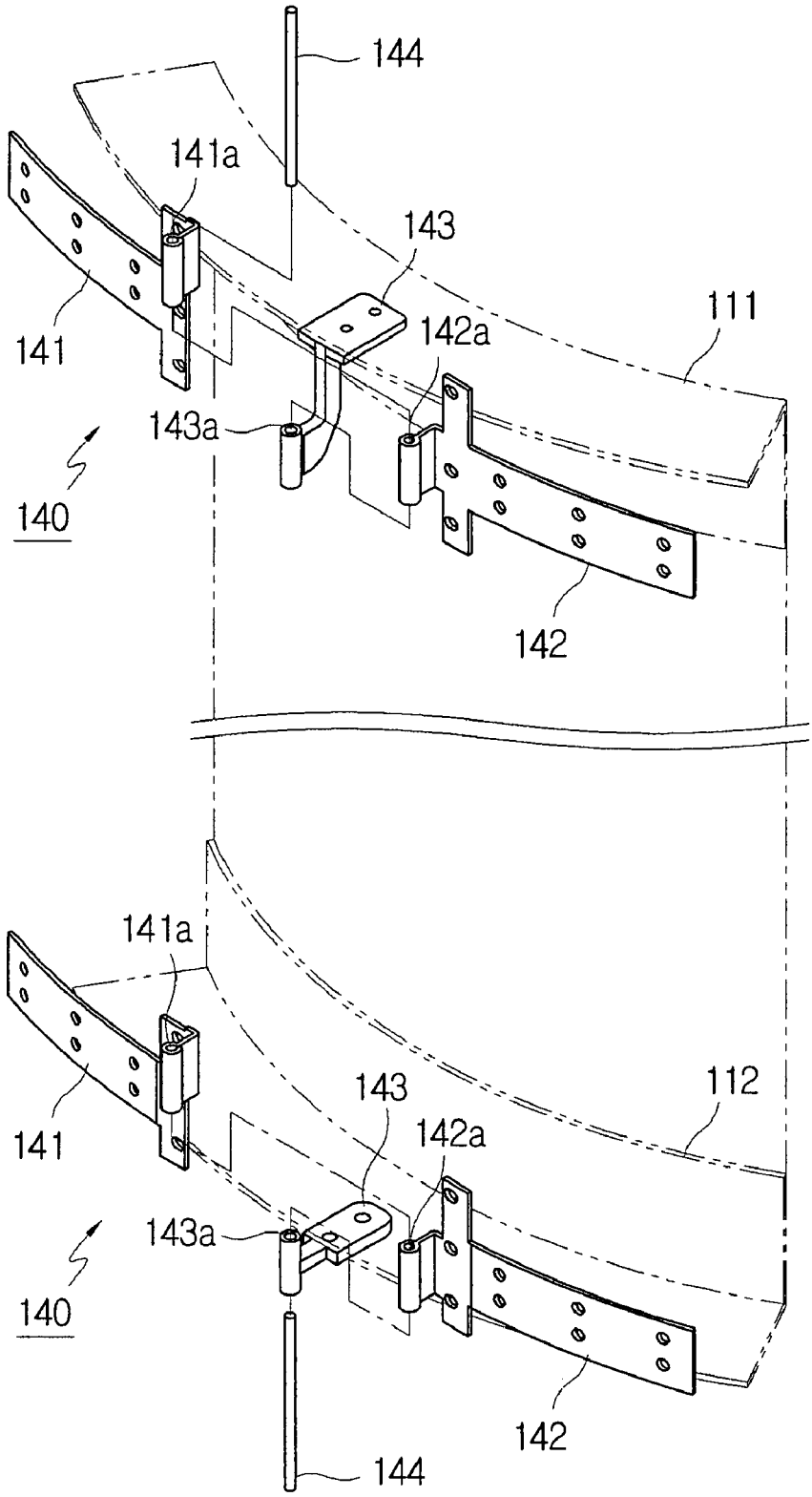
FIG. 6 is an exploded perspective view showing hinge assemblies of the rotary sign board of the present invention.
Figure 7:
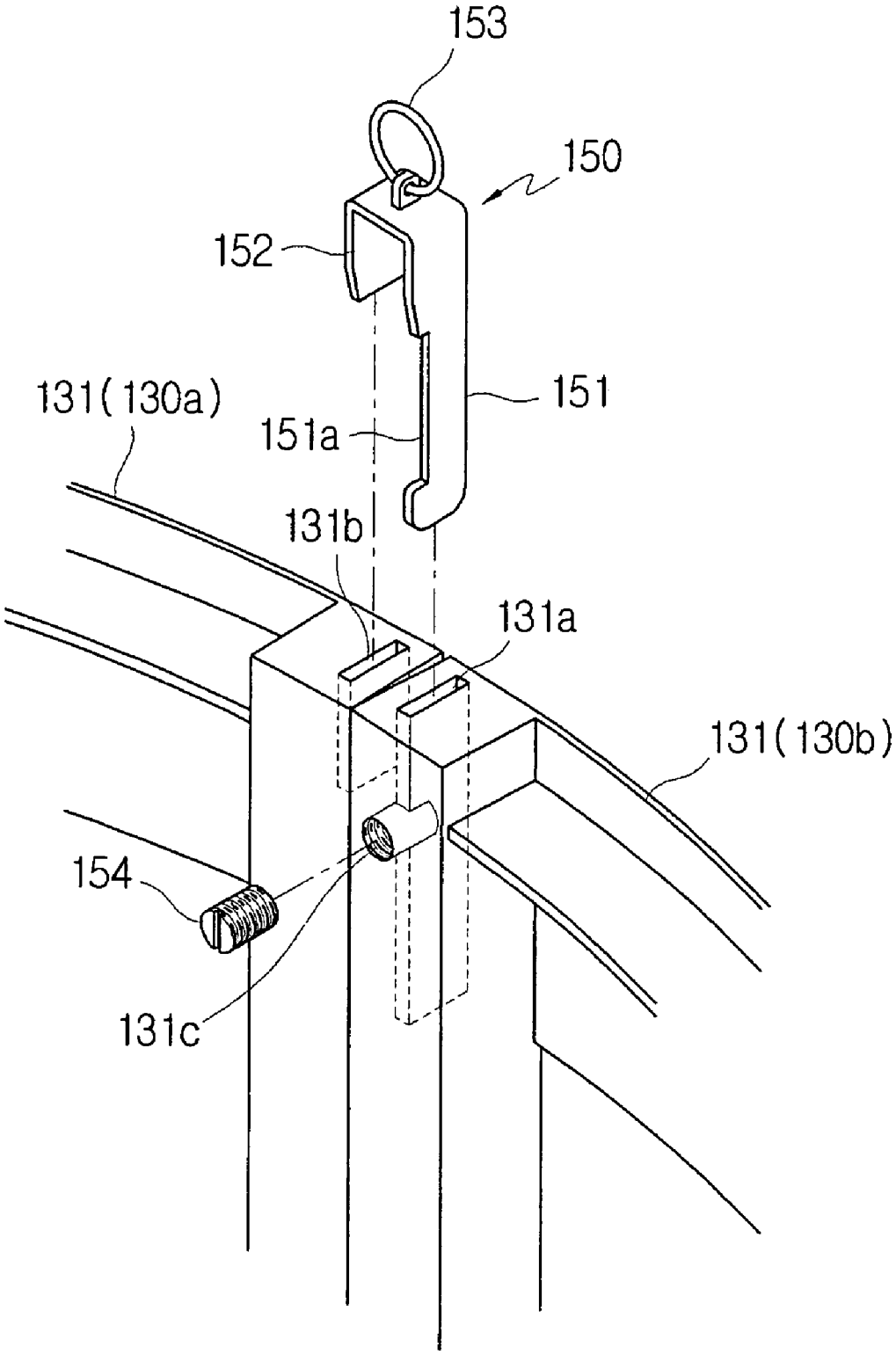
FIG. 7 is an exploded perspective view showing a locking device of the rotary sign board of the present invention.

FIG. 2 is a perspective view showing a rotary sign board according to the principles of the present invention, FIG. 3 is a perspective view showing a frame of the rotary sign board of the present invention, and FIG. 4 is an exploded perspective view showing a display assembly of the rotary sign board of the present invention. In addition, FIG. 5 is a perspective view showing a case of the rotary sign board of the present invention, FIG. 6 is an exploded perspective view showing hinge assemblies of the rotary sign board of the present invention, and FIG. 7 is an exploded perspective view showing a locking device of the rotary sign board of the present invention.

First, as shown in FIG. 2, the rotary sign board of the present invention includes a frame 110 installed on a post W of a structure, a display assembly 120, a case 130, and a plurality of hinge assemblies 140.

As shown in FIG. 3, the frame 110 includes a circular top frame body 111 arranged to surround the post W, a circular bottom frame body 112 located at a distance from the top frame body 111 and arranged to surround the post like the top frame body 111, a tie bar 113 for interconnecting the upper and bottom frame bodies 111 and 112, a plurality of support arms 114, each of which is formed with a bifurcated contact piece 114*a* at one end thereof so that the one end of the support arm 114 is in contact with the post through the bifurcated contact piece 114*a* and the other end is anchored to the top frame body 111 or the bottom frame body 112, a plurality of rubber members 114*b* where each end of the contact pieces 114*a* is covered by one of the rubber members 114*b*, a plurality of leg members 115 that are anchored to the bottom face of the bottom frame body 112 where each leg member 115 is formed with a leveling part 115*a* at the bottom end thereof, and a plurality of rollers 111*a* and 112*a* arranged on the outer peripheries of the upper and bottom frame bodies 111 and 112 to be capable of idling where the rollers are equally spaced from each other in the circumferential direction.

As shown in FIG. 4, the display assembly 120 includes a top rail 121 rotatably installed through the rollers 111*a* of the top frame body 111, a bottom rail 122 rotatably installed through the rollers 112*a* of the bottom frame body 112, a plurality of support plates formed from polycarbonate and arranged in a cylindrical form between the top rail 121 and the bottom rail 122, a plurality of vertical anchoring bars 124 for interconnecting the top and bottom rails 121 and 122 where each of the anchoring bars 124 has a pair of vertical film insertion slits 124*a* formed adjacent to opposite longitudinal edges thereof and through-holes 124*b* formed to be communicated with the vertical film insertion slits 124*a*, a plurality of horizontal anchoring bars 125 where each of the horizontal anchoring bars 125 is formed with a horizontal film insertion slit 125*a* and anchored to the top rail 121 or the bottom rail 122, a pair of advertisement films 126 inserted into the vertical film insertion slits 124*a* of the vertical anchoring bars 124 and the horizontal anchoring bars 125, and a plurality of anchoring screws 127 inserted through and anchoring the vertical anchoring bars 124. Here, the vertical anchoring bars 124 are spaced apart from each other so that each of the advertisement films 126 can be anchored between two adjacent anchoring bars.

As shown in FIG. 5, the case 130 is split into two or more split case sections, which are arranged to surround the outer periphery of the display assembly 120. Each of the case sections 130*a* and 130*b* includes a rectangular frame 131 and a transparent window 132 fitted in the internal space defined by the rectangular frame 131.

Here, the rectangular frames 131 of the case sections 130*a* and 130*b* are formed with an insertion groove 131*a* and an anchoring groove 131*b* at the top ends of one pair of adjacent lateral edges thereof, the insertion groove 131*a* and the anchoring groove 131*b* having depths different from each other. The insertion groove 131*a* is more deeply formed than the anchoring groove 131*b*, and a through-hole 131*c* is formed at one side of the insertion groove 131*a* and communicates with the insertion groove 131*a*. In addition, the rectangular frames 131 of the case sections 130*a* and 130*b* are formed with hinge insertion grooves 131*d* at the top and bottom ends of the other pair of adjacent lateral edges thereof, respectively.

As shown in FIG. 6, each of the hinge assemblies 140 includes first hinge plates 141 formed with first pin bores 141*a*, second hinge plates 142 formed with second pin bores 142*a*, anchoring brackets 143 where the rear end of each anchoring bracket is anchored to the top frame body 111 or the bottom frame body 112 and the front end of each anchoring bracket is formed with an anchoring pin bore 143*a*, and connection pins 144 inserted into the pin bores 141*a*, 142*a* and 143*a* of the first hinge plate 141, the second hinge plate 142 and the anchoring bracket 143. The hinge assemblies 140 are provided at the top and bottom ends of the adjacent lateral edges of the rectangular frames 131 of the case sections 130*a* and 130*b*, respectively, thereby permitting the case sections 130*a* and 130*b* to be pivoted about the hinge assemblies 140 on the frame 110.

Meanwhile, the case sections 130*a* and 130*b* are provided with locking device 150 (shown in FIG. 7) for limiting the opening of the case sections 130*a* and 130*b*. The locking device 150 are provided on the top and bottom ends of the rectangular frames 131 of the case sections 130*a* and 130*b* at an area to be opened.

As shown in FIG. 7, the locking device 150 located at the top end of the rectangular frames 131 of the case sections 130*a* and 130*b* includes an elongated leg 151 bent downward at one side of the locking device 150, an anchoring leg 152 bent downward at the other side of the locking device 150, and a ring-like handle 153 formed at the center of the top side of the locking device 150. The elongated leg 151 is substantially parallel to the anchoring leg 152. The elongated leg 151 is formed with an elongated groove 151*a* at a longitudinal edge thereof, and is inserted into the insertion groove 131*a* formed one of the case sections 130*a* and 130*b*. The anchoring leg 152 is inserted into the anchoring groove 131*b* of the other case section 130.

In addition, in order to prevent the elongated leg 151 from being inadvertently released from the insertion groove 131*a*, an anchoring screw 154, which serves as anti-release means, is inserted into the through-hole 131*c* formed at the one side of the insertion groove 131*a*.

Here, the tip end of the anchoring screw 154 inserted into the through-hole 131*c* is inserted into the elongated groove 151*a* formed on the elongated leg 151, wherein the length of the elongated groove 151*a* is determined to correspond to the insertion and release distance of the anchoring leg 152 in relation to the insertion groove 131*a*.

Meanwhile, the locking device 150' located at the bottom side of the case sections 130*a* and 130*b* is implemented by a locking device which can be locked or released by a separate key, so that a manager possessing the key can unlock or lock the case sections 130*a* and 130*b*. Because such a locking device 150' is well known in the art, a detailed description thereof will be omitted.

Now, the action of the rotary sign board of the present invention configured as described above will be described.

Figure 8:
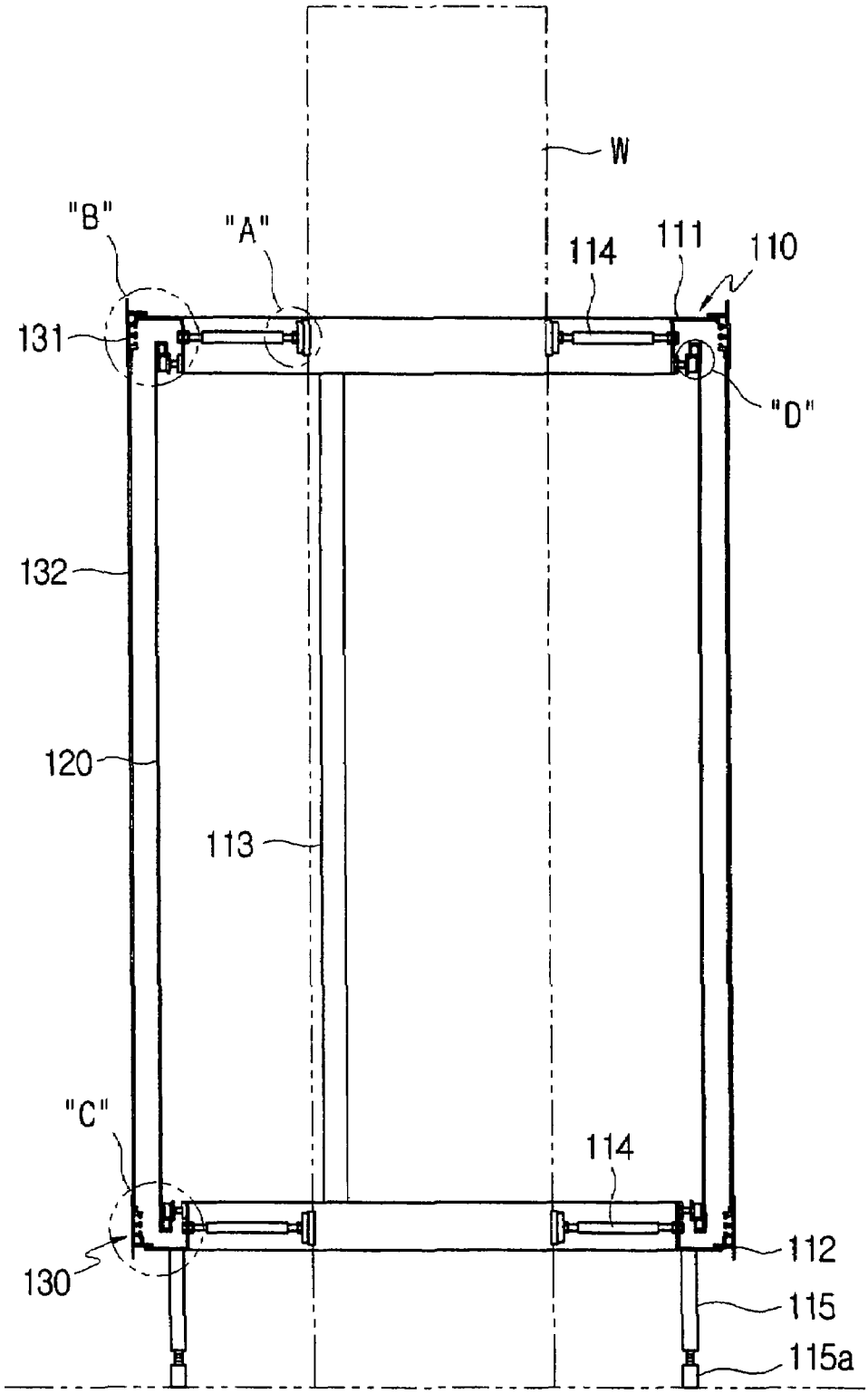
FIG. 8 is a cross-sectional view of the rotary sign board of the present invention.

Referring to FIG. 8, the circular bottom frame body 112 of the frame 110 arranged to surround a post W are supported on the floor by the leg members 115 located at the bottom side of the bottom frame body 112, wherein the horizontal height of the frame 110 is adjusted through the leveling parts 115*a* formed at the bottom ends of the leg members 115. The bottom frame body 112 is anchored to the post W when the rear ends of the support arms 114 are anchored to the bottom frame body 112 while the front ends of the support arms 114 are supported on the outer peripheral surface of the post W.

In addition, the top frame body 111 is anchored to the post W when the rear end of the support arms 114 are anchored to the top frame body 111 while the front ends of the support arms 114 are supported on the outer peripheral surface of the post W, like the bottom frame body 112. The top frame body 111 is spaced apart from the bottom frame body 112, and the space between the top frame body 111 and the bottom frame body 112 is uniformly maintained by the tie bar 113 anchored to the top frame body 111 and the bottom frame body 112.

Figure 9:
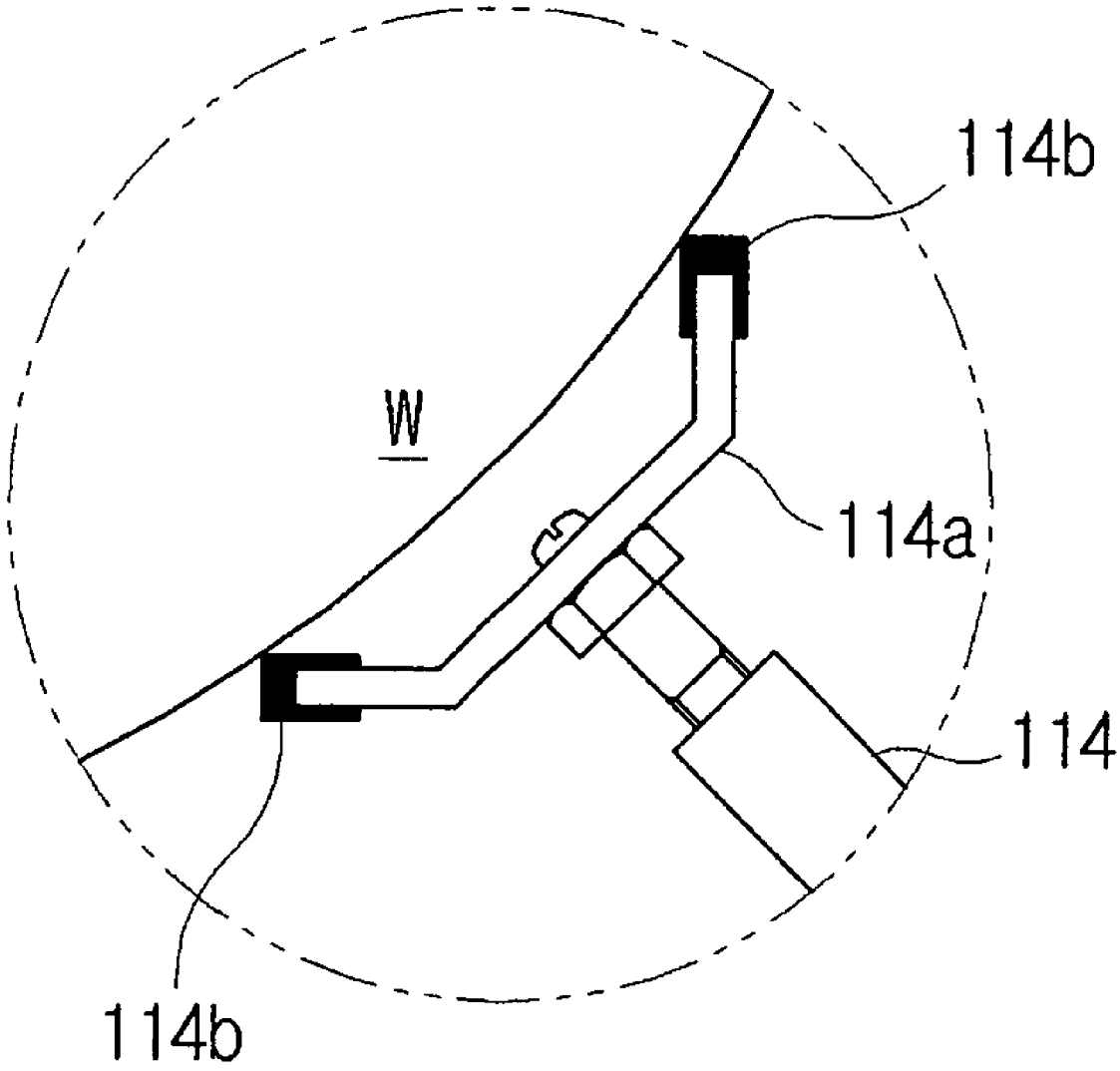
FIG. 9 is an enlarged plan view showing the "A" part of FIG. 8.

FIG. 9 is an enlarged plan view showing the "A" part of FIG. 8. As shown in FIG. 9, each of the bifurcated contact pieces 114*a* is covered by the rubber members 114*b* at the opposite ends thereof, and therefore the contact pieces 114*a* are in contact with the post through the rubber members 114*b*. The support arms 114 are elastically anchored to the post and the tip ends of the contact pieces 114*a* are prevented from being slid.

Figure 10:
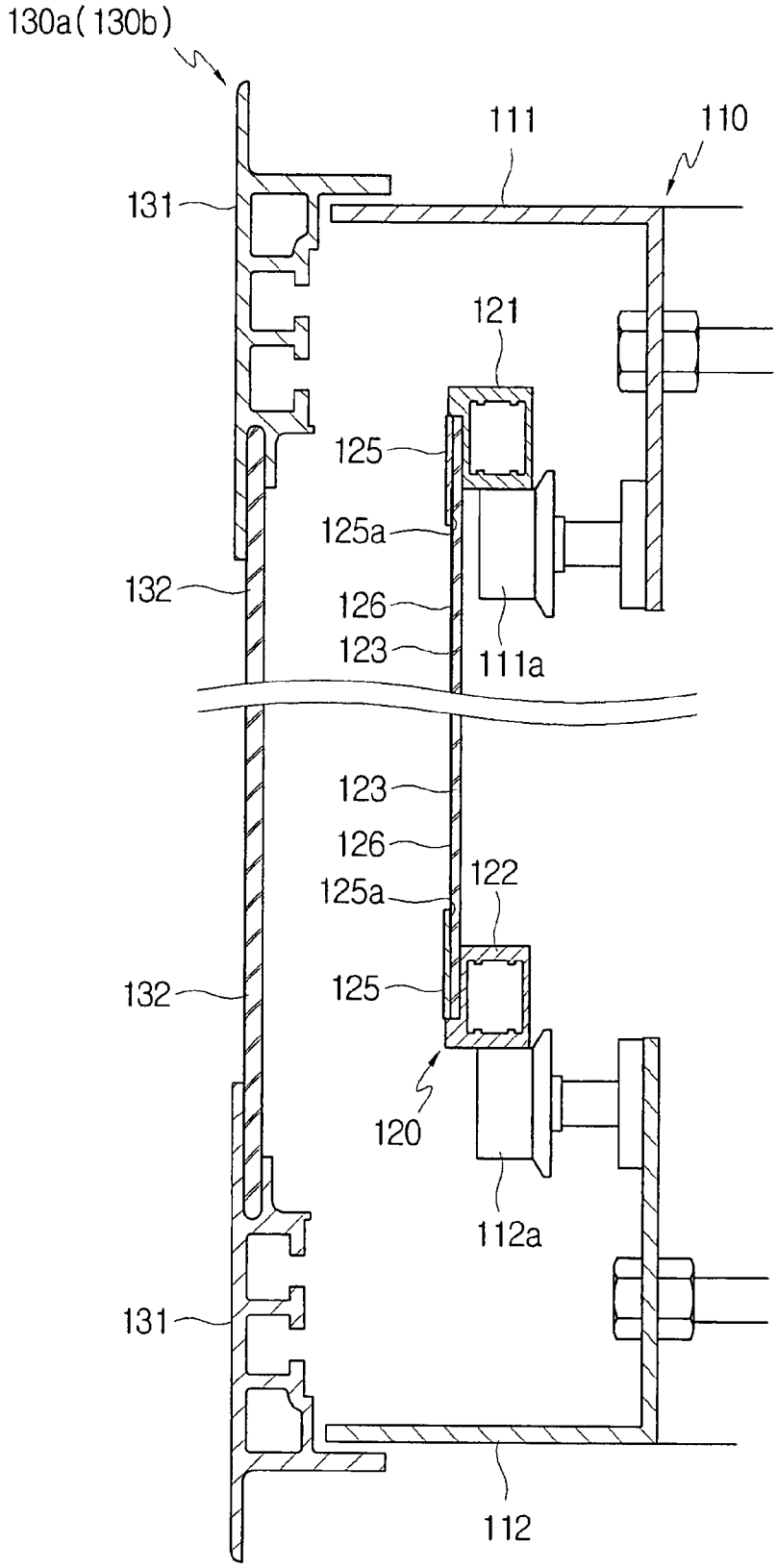
FIG. 10 is an enlarged view showing the "B" and "C" parts of FIG. 8.

FIG. 10 is an enlarged view showing the "B" and "C" parts of FIG. 8. As shown in FIG. 10, the top and bottom ends of the rectangular frames 131 of the case sections 130*a* and 130*b* are located at the outside of the top and bottom frame bodies 111 and 112 of the frame 110, and the transparent windows 132 are fitted in the rectangular frames 131 anchored to the top and bottom frame bodies 111 and 112.

The display assembly 120 is rotatably installed between the top and bottom frame bodies 111 and 112 inside of the transparent windows 132 of the case sections 130*a* and 130*b*.

The display assembly 120 is assembled in the following manner. A plurality of rotatable rollers 111*a* and 112*a* are provided on the top and bottom frame bodies 111 and 112. The top rail 121 is located above the rollers 111*a* provided on the top frame body 111, and the bottom rail 122 is located below the rollers 112*a* provided on the bottom frame body 112, wherein the cylindrical support plate 123 formed from polycarbonate is anchored between the top and bottom frame bodies 111 and 112.

In addition, the horizontal anchoring bars 125, each of which are formed with the horizontal film insertion slit 125*a*, are oppositely fixed to the top and bottom frame bodies 111 and 112, respectively. Therefore, the top and bottom edges of an advertisement film 126 with advertisement information are inserted into the film insertion slits 125*a* of the top and bottom horizontal anchoring bars 125, and the rear side of the advertisement film 126 is supported by the support plate 126.

In addition, each of the vertical anchoring bars 124, which are provided between the top and bottom rails 121 and 122 to be spaced apart from each other so as to allow a plurality of split advertisement films 126, is provided with vertical film insertion slits 124*a* at the opposite longitudinal edges thereof.

Therefore, the split advertisement films 126, the top and bottom edges of which have been inserted into the horizontal film insertion slits 125*a* of the top and bottom horizontal bars 125, are arranged to be in close contact with the support plate 123 by inserting the opposite lateral edges of the film 125 into the vertical film insertion slits 124*a* of the vertical anchoring bars 124.

Figure 11:
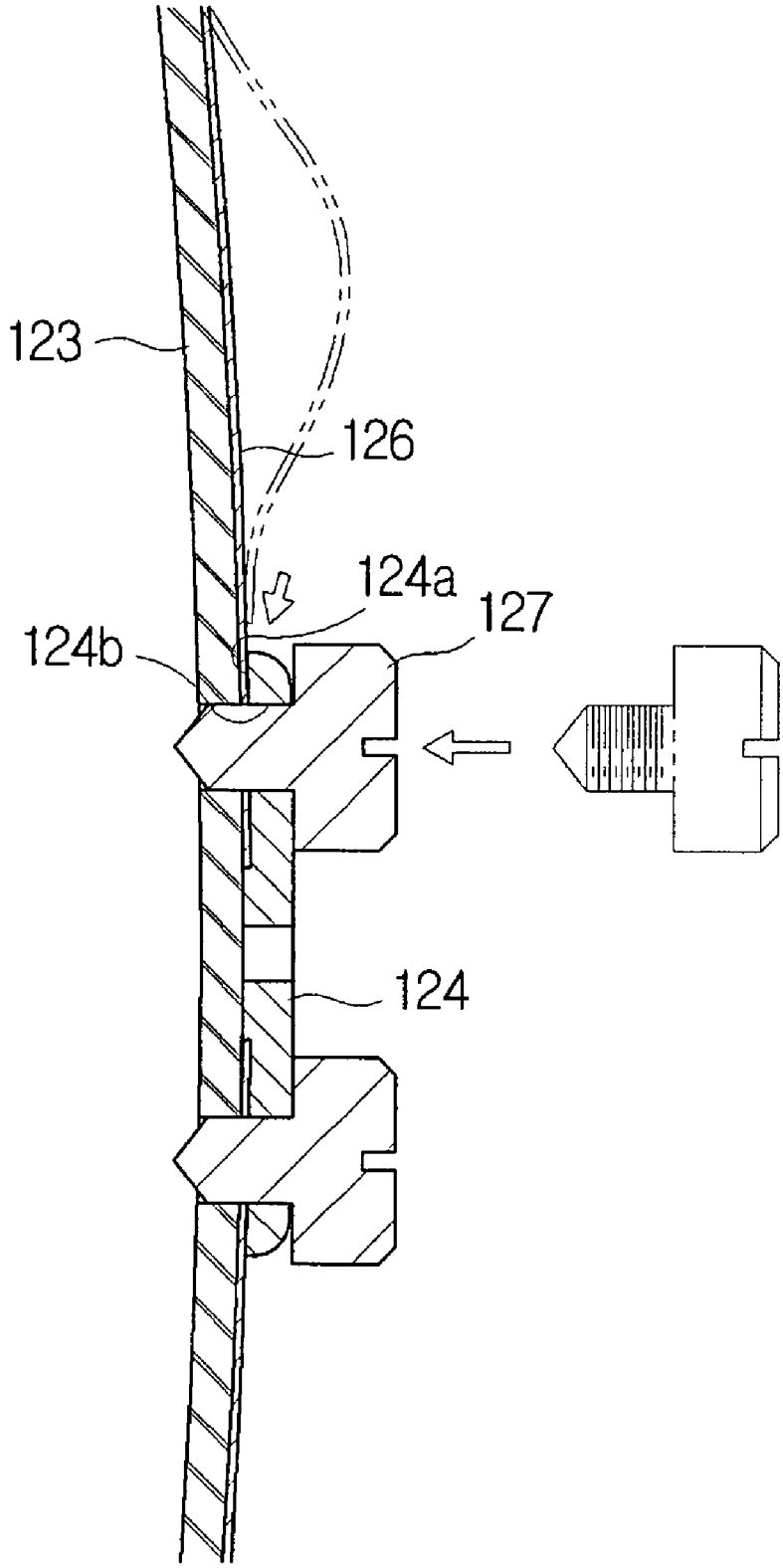
FIG. 11 is an enlarged plan view showing the "D" part of FIG. 8.

FIG. 11 is an enlarged plan view showing the "D" part of FIG. 8. Referring to FIG. 11, if the anchoring screws 127 are inserted into the through-holes 124*b* formed through the vertical anchoring bars 125, the split advertisement films 126 interposed between the tip ends of the anchoring screws 127 and the support plate 123 are compressed between the tip ends of the anchoring screws 127 and the support plate 123, or are penetrated by the tip ends of the anchoring screws 127, thereby anchoring the advertisement films 126.

To the contrary, when removing the split advertisement films 126, the advertisement films 126 can be easily removed from the film insertion slits 124*a* of the vertical anchoring bars 126 by rotating the anchoring screws 127 in the direction of releasing the anchoring screws 127 so that the anchoring of the advertisement films 126 is released, and then by pulling the advertisement films 126.

Figure 12:
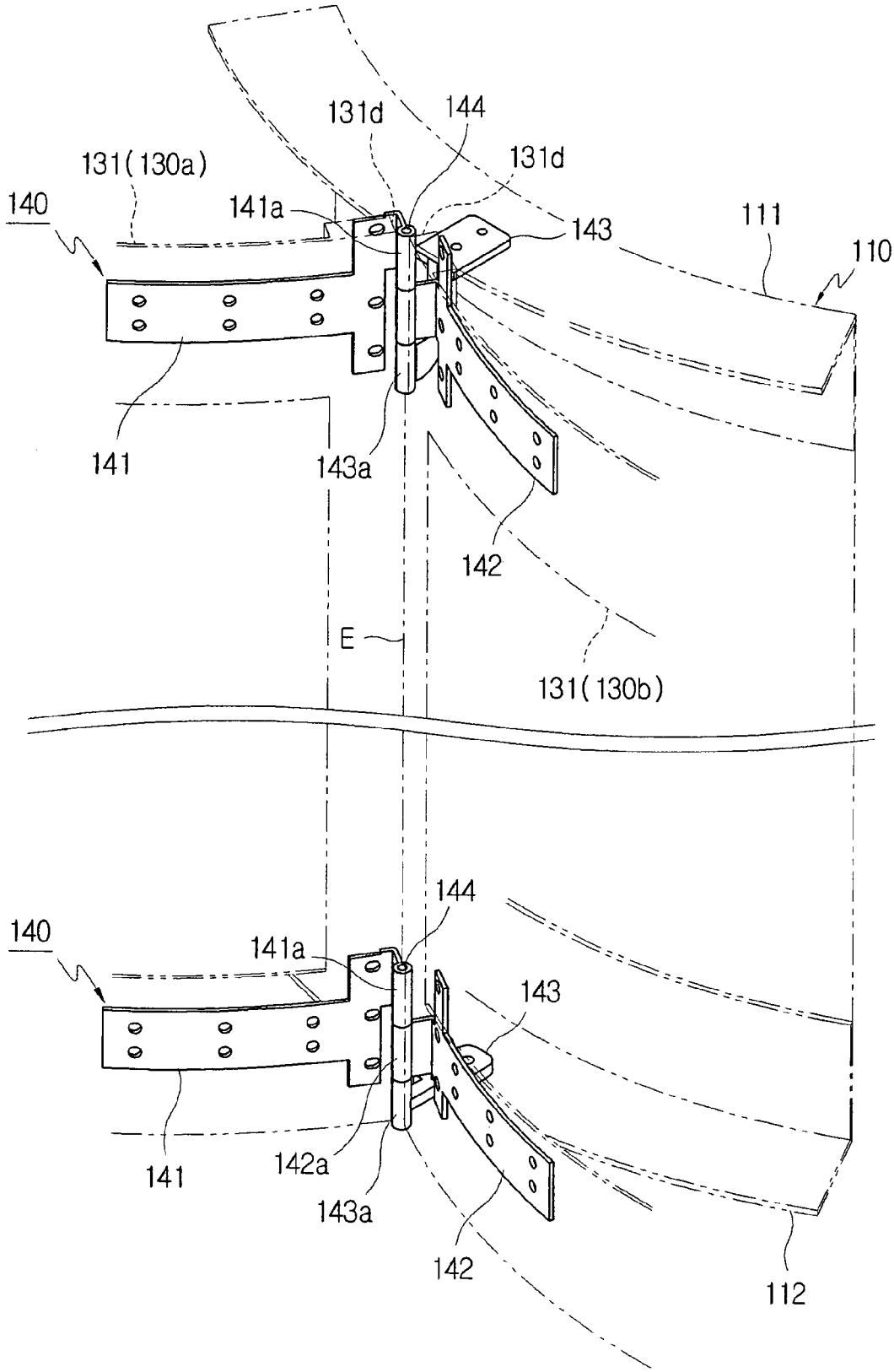
FIG. 12 is a perspective view showing hinge assemblies of the rotary sign board of the present invention.

As shown in FIG. 12, the case sections 130*a* and 130*b* can be pivoted from the frame 110 through the hinge assemblies provided at the top and bottom parts of the case sections 130*a* and 130*b*.

In the case of the hinge assembly 140 positioned at the bottom end, the rear ends of the first and second hinge plates 141 and 142 are anchored to the bottom ends of oppositely adjacent case sections 130*a* and 130*b*, respectively, and the rear end of the anchoring bracket 143 is anchored to the bottom frame body 112. In this state, a connection pin 144 is inserted through the pin bores 141*a*, 142*a* and 143*a* formed in the first hinge plate 141, the second hinge plate 142, and the anchoring bracket 143.

In the case of the hinge assembly 140 positioned at the top end, the rear ends of the first and second hinge plates 141 and 142 are anchored to the top ends of the oppositely adjacent case sections 130*a* and 130*b*, respectively, and the rear end of the anchoring bracket 143 is anchored to the top frame body 111. In this state, a connection pin 144 is inserted through the pin bores 141*a*, 142*a* and 143*a* formed in the first hinge plate 141, the second hinge plate 142, and the anchoring bracket 143.

Meanwhile, the pin bores 141*a*, 142*a* and 143*a* are inserted into the hinge insertion grooves 131*d*, which are formed at the top and bottom ends of one pair of adjacent lateral edges of the rectangular frames 131 of the case sections 130*a* and 130*b*, respectively. As a result, the interface E between the case sections is positioned at the rotational center of the hinge assembly, whereby no gap is produced in the interface between the case sections 130*a* and 130*b* when the case sections are opened or closed.

In the assembly as described above, the first hinge plates 141 and the second hinge plates 142, which are anchored to the pair of the split case sections 130*a* and 130*b*, respectively, are connected with the brackets 143, which are anchored to the bottom frame body 112 and the top frame body 111, respectively, through the connection pins 144. As a result, the split case sections 130*a* and 130*b* can be pivoted about the connection pins 144, thereby being opened or closed.

Figure 13:
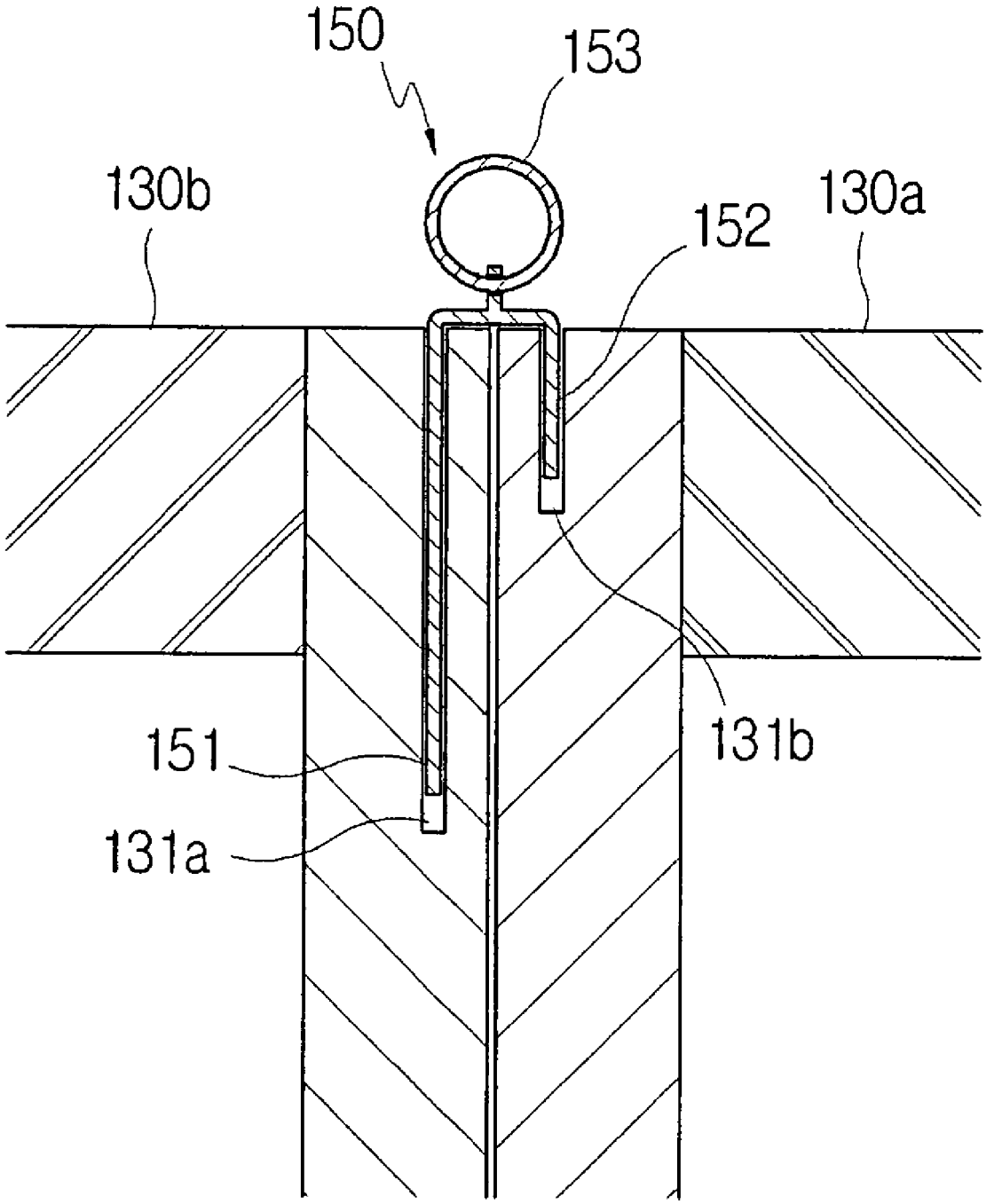
FIG. 13 is a front cross-sectional view showing locking device of the sign board of the present invention.
Figure 14:
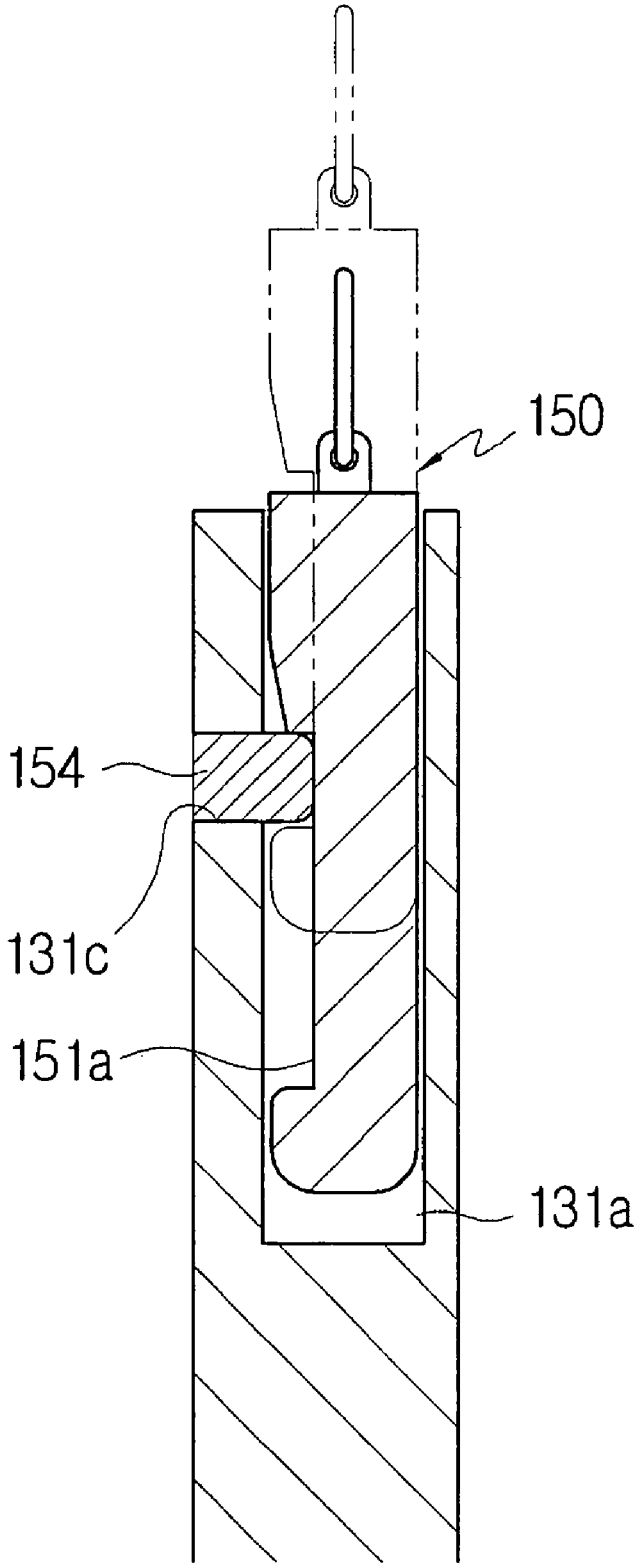
FIG. 14 is a side cross-sectional view showing the locking device of the sign board of the present invention.

Referring to FIGS. 13 and 14, with the locking device 150 provided at the top of the case sections 130*a* and 130*b*, the elongated leg 151 of the locking device 150 is inserted into the insertion groove 131*a* formed in one of the case sections 130*a* and 130*b*, and the anchoring leg 152 of the locking device 150 is inserted into the anchoring groove 131*b* formed in the other case sections 130*a* and 130*b*. The locking device 150 limits the opening of the case sections 130*a* and 130*b*.

At this time, because the anchoring leg 152 is shorter than the elongated leg 151, the elongated leg 151 remains in the insertion groove 131*a*, even if the anchoring leg 152 is removed from the anchoring groove 131*b* so as to release the locking state.

In addition, if it is desired to release the locking state, it is possible to pull the locking device 150 upward by using the ring-like handle 153 provided at the top of the locking device. Therefore, the locking state can be easily released.

Furthermore, if an anchoring screw 154, which serves as an anti-release means, is inserted into the through-hole 131*c* formed through a side of the insertion groove 131*a*, the tip end of the anchoring screw 154 is engaged in the elongated groove provided on a side of the elongated leg 151. The elongated leg 151 is prevented from being released from the insertion groove 131*a*.

Meanwhile, the locking device 150' provided at the bottom part is locked or released by a separate key, wherein a locking device locked or released by a key can be employed for the locking device 150'. Therefore, because such a locking device is well known in the art, a detailed description thereof will be omitted.

As described above, in the rotary sign board of the present invention, the case is split into two or more case sections surrounding the display assembly, wherein the split case sections are capable of being pivoted through the hinge assemblies, thereby being opened or closed. As a result, the advertisement object positioned within the rotary sign board can be easily replaced.

In the of the present invention rotary sign board, the edges of an advertisement film are inserted into the vertical anchoring bars and horizontal anchoring bars, and then the film is compressed and anchored by inserting the anchoring screws through the vertical anchoring bars. As a result, the advertisement film can be simply and conveniently installed or removed.

In addition, the vertical bars are arranged at a predetermined interval so that advertisement films can be fitted between the vertical anchoring bars, respectively. As a result, one or more selected advertisement films can be replaced.

In addition, the rotary sign board of the present invention is formed with hinge grooves at the top and bottom ends of the adjacent edges of the case sections at the side where the hinge assemblies are installed. As a result, it is possible to prevent a gap from being produced in the interface between the adjacent case sections when the case sections are opened or closed.

In the rotary sign board of the present invention, the locking device for limiting the opening of the case sections is prevented from being inadvertently released. As a result, it is possible to prevent the loss of the locking device.

In the rotary sign board of the present invention, the frame anchored to the outer peripheral surface of a post is supported on a post through the support arms, each of which has tip ends covered by rubber members. As a result, the frame can be elastically anchored.

While the present invention has been described with reference to the particular illustrative embodiments, it is not to be restricted by the embodiments but only by the appended claims, and therefore, it is to be understood that other modifications and variations may be made without departing from the substance and scope of the present invention, as those skilled in the art will readily understand. Such alternate modifications and variations are within the scope of the present invention which is intended to be limited only by the appended claims and equivalents thereof.

What is claimed is:

1. A rotary sign board comprising:

a post;

a frame surrounding the post, the frame having a top frame body and a bottom frame body that is spaced apart from the top frame body;

a display assembly disposed between the top frame body and the bottom frame body, the display assembly being installed rotatably about the post;

a case arranged between the top frame body and the bottom frame body so as to surround the outer periphery of the display assembly, the case including at least two case sections; and hinge assemblies provided at a top and a bottom lateral edges of each of the case sections in order to allow the case sections to be pivoted, each of the hinge assemblies comprising:

an anchoring bracket anchored to the top frame body or the bottom frame body;

a first hinge plate anchored to each of the case sections;

a second hinge plate anchored to each of the case sections; and a connection pin inserted into the anchoring bracket, the first hinge plate, and the second hinge plate.

2. The rotary sign board as defined in claim 1, wherein each of the case sections includes:

a rectangular frame and a transparent window fitted in the rectangular frame.

3. The rotary sign board as defined in claim 2, wherein the rectangular frames are formed with hinge insertion grooves at a top and a bottom ends of one pair of adjacent edges thereof.

4. The rotary sign board as defined in claim 3, further comprising a locking device for coupling one of the two case sections to another of the two case sections.

5. The rotary sign board as defined in claim 4, wherein an insertion groove is formed at a top edge of the rectangular frame of one of the two case sections, and an anchoring groove is formed at a top edge of the rectangular frame of another of the two case sections, and wherein the locking device has an elongated leg inserted into the insertion groove, and an anchoring leg inserted into the anchoring groove, the elongated leg being substantially parallel to the anchoring leg, the anchoring leg being shorter than the elongated leg so that the locking/releasing of the locking device is performed by the anchoring leg.

6. The rotary sign board as defined in claim 5, wherein the locking device includes a handle.

7. The rotary sign board as defined in claim 5, wherein the locking device further comprises an anti-release means for preventing the release of the elongated leg inserted into the insertion groove.

8. The rotary sign board as defined in claim 7, wherein a through-hole is formed at one side of the insertion groove, an elongated groove is formed on a side of the elongated leg, and the anti-release means includes a stop screw inserted through the through-hole so that an end of the stop screw is inserted into the elongated groove of the elongated leg inserted into the insertion groove.

9. The rotary sign board as defined in claim 1, wherein the top and bottom frame bodies are fixedly installed on the post through a plurality of support arms, a front end of each of the support arms being formed with a bifurcated contact piece so as to be in contact with the post through the contact piece, and a rear end of each of the support arms being anchored to the top frame body or the bottom frame body.

10. The rotary sign board as defined in claim 9, wherein the ends of contact pieces are covered by rubber members.

11. A rotary sign board comprising:

a post;

a frame surrounding the post, the frame having a top frame body and a bottom frame body that is spaced apart from the top frame body;

a display assembly disposed between the top frame body and the bottom frame body, the display assembly comprising:

a top rail rotatably installed on the top frame body;

a bottom rail rotatably installed on the bottom frame body;

at least two vertical anchoring bars for vertically interconnecting the top rail and the bottom rail, each of the vertical anchoring bars being formed with vertical film insertion slits along opposite vertical edges of the each of the vertical anchoring bars;

a pair of horizontal anchoring bars anchored to the top rail and the bottom rail, respectively, a horizontal film insertion slit is formed at an edge of the each of the horizontal anchoring bars; and an advertisement film, edges of the advertisement film are inserted into the vertical film insertion slits of the vertical anchoring bars and into the horizontal film insertion slits of the horizontal anchoring bars;

a case arranged between the top frame body and the bottom frame body so as to surround the outer periphery of the display assembly, the case including at least two case sections; and hinge assemblies provided at a top and a bottom lateral edges of each of the case sections in order to allow the case sections to be pivoted.

12. The rotary sign board as defined in claim 11, wherein the display assembly further comprises an anchoring screw for anchoring the advertisement film.

13. The rotary sign board as defined in claim 12, wherein the display assembly further comprises a support plate arranged between the top rail and the bottom rail, the support plate having a cylindrical shape so as to support a rear side of the advertisement film.

14. A rotary sign board comprising:

a post;

a frame surrounding the post, the frame having a top frame body and a bottom frame body that is spaced apart from the top frame body;

a display assembly disposed between the top frame body and the bottom frame body, the display assembly comprising:

a top rail rotatably installed on the top frame body;

a bottom rail rotatably installed on the bottom frame body;

at least two vertical anchoring bars for vertically interconnecting the top rail and the bottom rail, each of the vertical anchoring bars being formed with vertical film insertion slits along opposite vertical edges of the each of the vertical anchoring bars;

a pair of horizontal anchoring bars anchored to the top rail and the bottom rail, respectively, a horizontal film insertion slit is formed at an edge of the each of the horizontal anchoring bars; and an advertisement film, edges of the advertisement film are inserted into the vertical film insertion slits of the vertical anchoring bars and into the horizontal film insertion slits of the horizontal anchoring bars;

a case arranged between the top frame body and the bottom frame body so as to surround the outer periphery of the display assembly, the case including at least two case sections; and a hinge assembly coupled to the case, the hinge assembly comprising:

an anchoring bracket anchored to the top frame body or the bottom frame body;

a first hinge plate anchored to each of the case sections;

a second hinge plate anchored to each of the case sections; and a connection pin inserted into the anchoring bracket, the first hinge plate, and the second hinge plate.

15. The rotary sign board as defined in claim 14, further comprising a locking device for coupling one of the two case sections to another of the two case sections.

16. The rotary sign board as defined in claim 15, wherein the display assembly further comprises an anchoring screw for anchoring the advertisement films by being inserted into the vertical anchoring bars.

17. The rotary sign board as defined in claim 16, wherein an insertion groove is formed at a top edge of a rectangular frame of one of the two case sections, and an anchoring groove is formed at a top edge of a rectangular frame of another of the two case sections, and wherein the locking device has an elongated leg inserted into the insertion groove, and an anchoring leg inserted into the anchoring groove, the elongated leg being substantially parallel to the anchoring leg, the anchoring leg being shorter than the elongated leg so that the locking/releasing of the locking device is performed by the anchoring leg.

18. The rotary sign board as defined in claim 17, wherein a through-hole is formed at one side of the insertion groove, an elongated groove is formed on a side of the elongated leg, and an anti-release means including a stop screw is inserted through the through-hole so that an end of the anti-release means is inserted into the elongated groove of the elongated leg inserted into the insertion groove.

* * * * *